United States Patent [19]

Schinke

[11] 4,449,475

[45] May 22, 1984

[54] CLEANING DEVICE FOR THE INTERMEDIATE IMAGE CARRIER OF AN ELECTROPHORETIC PRINTER

[75] Inventor: Franz Schinke, Hamburg, Fed. Rep. of Germany

[73] Assignee: U.S. Philips Corporation, New York, N.Y.

[21] Appl. No.: 357,249

[22] Filed: Mar. 11, 1982

[30] Foreign Application Priority Data

Mar. 20, 1981 [DE] Fed. Rep. of Germany ..... 31110878

[51] Int. Cl.[3] ..... G03G 15/01; G03G 15/06

[52] U.S. Cl. ..... 118/645; 15/306 B; 15/306 R; 15/316 R; 118/70; 118/104; 118/203; 118/652; 355/4; 355/15; 430/125

[58] Field of Search ..... 118/652, 645, 203, 104, 118/70; 430/125; 355/4, 15; 15/306 R, 306 B, 316 R

[56] References Cited

U.S. PATENT DOCUMENTS

| | | | |
|---|---|---|---|
| 3,767,300 | 10/1973 | Brown et al. | 355/15 |
| 3,900,003 | 8/1975 | Sato et al. | 118/652 X |
| 4,210,977 | 7/1980 | Lillibridge | 118/203 X |
| 4,348,684 | 9/1982 | Binder | 355/15 X |

FOREIGN PATENT DOCUMENTS 2944708 5/1981 Fed. Rep. of Germany .

*Primary Examiner*—Bernard D. Pianalto
*Attorney, Agent, or Firm*—Norman N. Spain

[57] ABSTRACT

The cleaning device for the drum-shaped intermediate image carrier of an electrophoretic printer is used in the field of technical data processing in order to improve the quality of the electrophoretically printed color images. The toner suspensions of different color used must be removed from the intermediate image carrier and must be separately applied to separate collecting reservoirs, one of which is provided for each toner suspension color. To this end, a ruler-shaped upper edge (5, 11) of an air duct (21) forms a narrow gap in conjunction with the intermediate image carrier (1). Therethrough air is forced in order to ensure that the toner suspension flows from the intermediate image carrier to a collecting reservoir (8) via a wiper (6) and a chute (7) of the cleaning device associated with each toner suspension. The chutes can be displaced so that accurate separation of the suspensions is ensured and each suspension is applied to the associated reservoir.

5 Claims, 2 Drawing Figures

CLEANING DEVICE FOR THE INTERMEDIATE IMAGE CARRIER OF AN ELECTROPHORETIC PRINTER

The invention relates to a device for the removal of toner suspensions of different colour and/or a cleaning liquid from an endless intermediate image carrier upon which toner suspensions of different colour are successively applied and on which the colour image is electrophoretically recorded after which the toner suspension residues are removed from the intermediate image carrier by means of forced air in order to be directed to associated collecting reservoirs.

The storage, processing, transfer and recording of images or characters has become very important in the field of technical data processing. Notably the importance of non-mechanical reproduction of electrically stored information on conventional image carriers, for example, paper is growing. The air is inter alia to improve the quality of the recorded images.

German Offenlegungsschrift No. 29 44 708 already discloses a method of and a device for the electrophoretic reproduction of multicolour images. For each colour of the toner suspension there is provided a separate nozzle whereby the relevant toner suspension is each time applied to the drum-like image carrier. After the recording on the endless intermediate image carrier and the transfer to the ultimate record carrier, the toner suspension is removed from the intermediate image carrier. For this purpose for each of the coloured toner suspensions an air nozzle, a collecting reservoir for rinsing liquid, and a collecting reservoir for toner suspension are arranged on a carriage. The suspension is removed in that the carriage is arranged underneath the image carrier, so that the air nozzle associated with the relevant toner suspension is situated exactly underneath the drum. The air nozzle then removes the suspension from the image carrier by means of compressed air and directs the suspension to the associated collecting reservoir. Subsequently, on the other side a rinsing liquid is applied to the drum in order to remove the last residues of the excess toner from the image drum. The rinsing liquid is also removed from the image carrier by means of compressed air from the active air nozzle in order to be applied to the associated reservoir. Subsequently, the carriage is moved until the air nozzle associated with the toner suspension for the next printing operation is situated exactly underneath the image drum, etc. For each of the toner suspensions used an air nozzle and a fan are then required. Moreover, the positioning of the air nozzle underneath the image drum requires a complex control device. In order to avoid contamination of the entire printer, the air nozzle should be active only when they are positioned exactly underneath the image drum; this implies that it must be possible to deactivate the nozzles, so that they are liable to be clogged. Furthermore, the collecting reservoirs for the various suspensions are accommodated in a mobile carriage, which means that the liquids are liable to spill over the edge of the reservoir or that the positioning device of the carriage must be designed so that spilling of the suspensions is precluded in order to prevent contamination of the entire printer.

It is an object of the invention to simplify the electrophoretic printer, notably the discharge device for toner suspensions, so that trouble-free operation is ensured without complex auxiliary devices being required.

This object is achieved in having the upper edges of a stationary air duct which is arranged underneath the intermediate image carrier approach the intermediate image carrier on both sides so closely that they form a narrow air gap in conjunction therewith, at the upper edges of the air duct there being provided projecting wipers which are directed away from the intermediate image carrier, several chutes being arranged so that, the upper side of the desired chute can be positioned underneath the wiper and its lower side can be positioned over the inlet opening of the associated stationary collecting reservoir.

One of the advantages is that this device for the cleaning of the image carrier requires only one fan for the removal of excess suspensions from the image carrier. Moreover, the fan may now operate continuously, because there is no risk that the liquid is blown away in an uncontrollable manner or that liquid can flow into the opening of the nozzles so that the nozzles become clogged. Furthermore, the cleaning device is arranged to be stationary underneath the image drum, so that it can be simply manufactured and mounted. As a result of the stationary mounting of the collecting reservoir, moreover, the risk of contamination of the entire printer by spilled toner suspension is eliminated.

The upper edge of the wiper preferably is provided at the sides with perpendicular slits whose width is determined by the air flow required. By variation of the width of the perpendicular slits, the outlet available for the outflowing air can be adjusted. The flow rate of the air forced through the gap between the upper edge of the wiper and the intermediate image carrier which is necessary for trouble-free operation of the wiper can be influenced by this means.

A further embodiment in accordance with the invention is characterized in that the endless intermediate image carrier is constructed as a drum which comprises an annular groove near both ends, said grooves being situated opposite the slits in the wiper. The advantage of such a construction in accordance with the invention consists in that a drum can be mounted without problems and that the drum also has a compact shape. The annular groove serves to prevent contamination of the entire printer because the suspension can now reach only the associated chute.

In a preferred embodiment the chutes and the collecting reservoir for the toner suspension are situated on one side of the air duct and the collecting reservoir for cleaning liquid are situated on the other side of the air duct.

Some embodiments in accordance with the invention will be described in detail hereinafter with reference to the drawing. Therein:

DETAILED DESCRIPTION OF THE DRAWINGS

Figure 1:
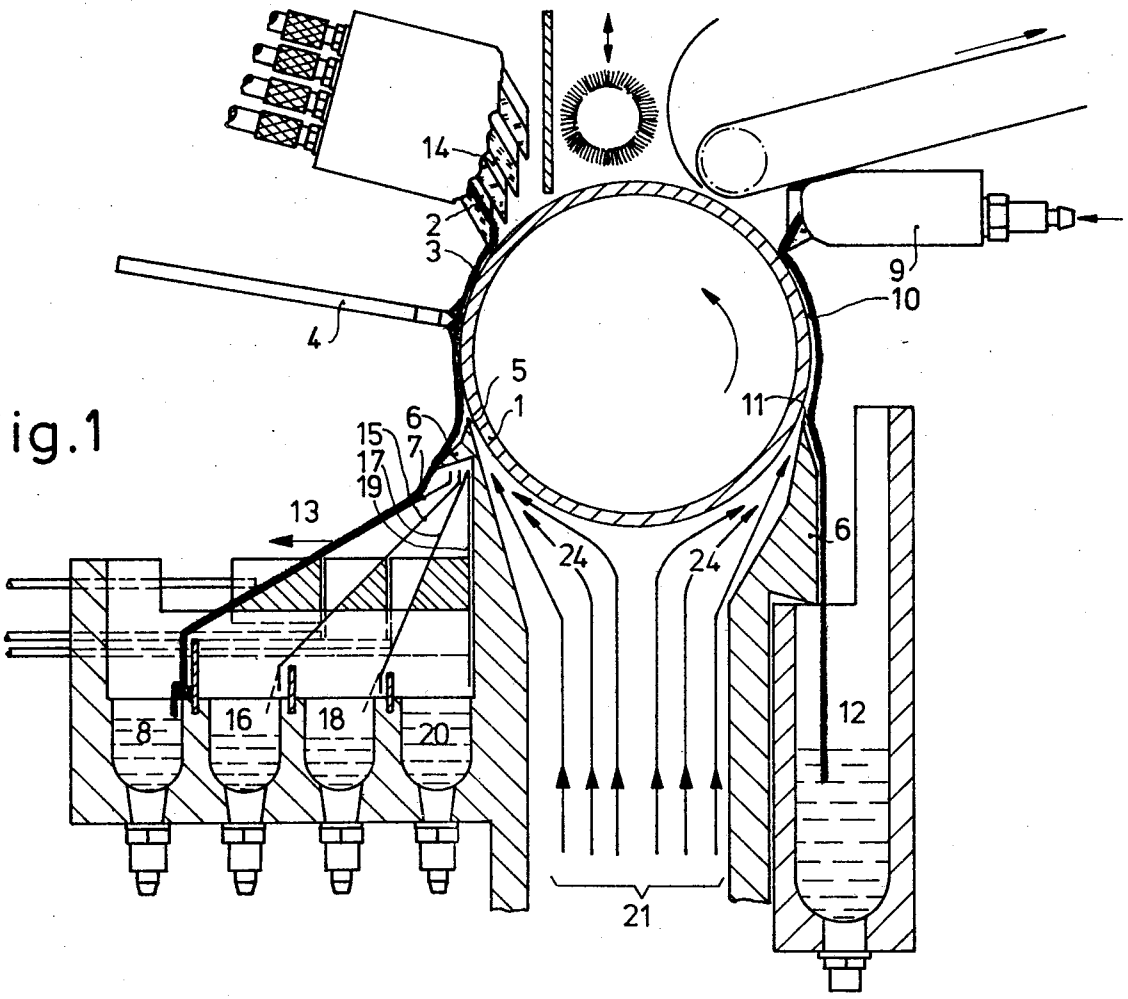
FIG. 1 is a cross-sectional view of an electrophoretic printer comprising a cleaning device.

The electrophoretic printing of a colour picture will be described with reference to FIG. 1. On one side of an intermediate image carrier 1 toner suspension 3 is supplied by a nozzle 2. The first colour component of the colour image is electrophoretically deposited on the intermediate image carrier by means of an electrode 4.

The excess toner suspension is forced, by means of an air flow 24 which is blown into an air duct 21, via an upper edge 5 and an inclined surface 6 of a wiper, to a chute 7 and further to a collecting reservoir 8. At the same time, a cleaning liquid 10 flows from a nozzle 9 onto the side of the intermediate image carrier 1 which is situated opposite the printing electrode 4. The cleaning liquid is directed to collecting reservoir 12, again by means of an air flow 24, via another upper edge 11 of the air duct 21 and an inclined surface 6 of a wiper. The cleaning liquid serves to remove the last residues of the excess toner from the intermediate image carrier.

The air gap between the upper edges 5 and 11 of the wipers and the intermediate image carrier 1 should be correctly adjusted because if the air gap is too narrow and hence the flow rate of the emerging air is too high, the entire printer is liable to be contaminated by the scattered suspension, while if the gap is too wide and hence the flow rate of the air is too low, part of the toner suspension adheres to the intermediate image carrier 1 and enters the air gap so that the fan (not shown) is contaminated.

Before the additional colour components of the multicolour image are electrophoretically deposited on the intermediate image carrier 1, the chute 7 is displaced in the direction of the arrow 13 and the toner suspension applied to the intermediate image carrier 1 from the nozzle 14 can then flow to the chute 15 via the upper edge of the wiper 5 and the inclined surface 6. The toner suspension of the second colour component of the multicolour image thus flows to the collecting reservoir 16. Similarly, after the displacement of the second chute 15, toner suspension will flow to the collecting reservoir 18 via the chute 17. The chute 19 which is connected to the chute 17 in a roof-like manner thus ensures that once the two chutes 17 and 19 have been displaced sufficiently far in the direction of the arrow 13, the last one of the coloured toner suspensions cannot reach a reservoir other than the reservoir 20.

Figure 2:
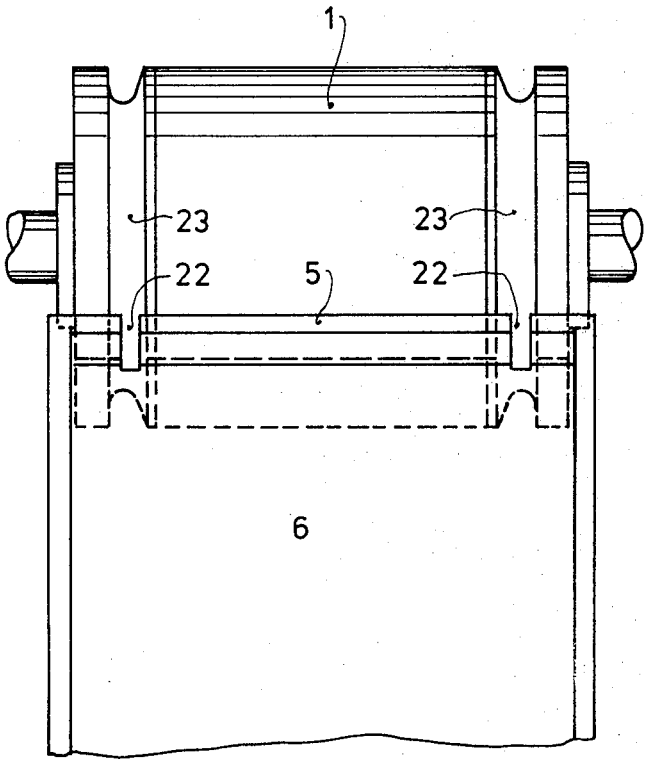
FIG. 2 is a plan view of the drum-shaped intermediate image carrier and an upper side of the wiper.

The air required for the cleaning of the intermediate image carrier 1 is applied to the printer via an air duct 21. The air emerges from the air gaps formed between the upper edges 5 and 11 of the air duct 21 and the intermediate image carrier 1. The flow rate of the air and hence the cleaning effect thereof depends on the overall cross-sectional area of the air gap. The size of this area can be influenced by means of the perpendicular slits 22 wich are diagrammatically shown in FIG.2 and which are situated in the upper side of the printer, opposite annual grooves 23 in the intermediate image carrier 1.

The gap 5 is wider at the area of the annular grooves 23, so that a larger quantity of air can flow through there. It is thus ensured that in the area of the intermediate image carrier which is situated between the two grooves 23 the liquid reaches the wiper and ultimately the collecting reservoir via the chute. This ensures accurate separation of the different suspensions as well as a high quality of the printed colour images.

What is claimed is:

1. A device for the removal of toner suspension of different colors and/or a cleaning liquid from an endless intermediate image carrier upon which carrier toner suspension of different colors are successively applied and on which a color image is electrophoretically recorded, after which recording residues of the toner suspension are removed from the intermediate image carrier by means of forced air in order to be deposited in associated collecting reservoirs, characterized in that upper edges (5, 11) of a stationary air duct (21) which is arranged underneath the intermediate image carrier (1) approach the intermediate image carrier (1) on both sides so closely that they form two narrow air gaps in conjunction therewith, each upper edge (5, 11) of the air duct (21) being joined to the upper edge of a wiper (6) projecting therefrom, each of which wiper (6) is directed away from the intermediate image device (1), several chutes (13, 15, 17, 19) being situated on one side of the air duct (21), said chutes being displaceable so that the upper side of a chute may be positioned underneath the wiper (6) on the said one side of the air duct (21) and its lower side may be positioned over the inlet opening of the associated, stationary collecting reservoir (8, 16, 18, 20), all of the chutes (13, 15, 17, 19) and the collecting reservoirs (8, 16, 18, 20) for each of the toner suspensions (3) being situated on the said one side of the air duct and on the side of the air duct (21) which is situated opposite the collecting reservoir (8, 16, 18, 20) for the toner suspension (3) there being arranged a collecting reservoir (12) for cleaning liquid (10).

2. A device as claimed in claim 1, characterized in that a displaceable chute (13, 15, 17, 19) is positioned to receive each coloured toner suspension.

3. A device as claimed in claim 1, characterized in that the upper edge of the wiper (6) comprises perpendicular slits (22) on the sides, the width of said slits being determinitive of the air flow required.

4. A device as claimed in claim 8, characterized in that the endless intermediate image carrier is constructed as a drum (1).

5. A device as claimed in clam 1, characterized in that the drum (1) used as the intermediate image carrier comprises an annular groove (23) near both ends.

* * * * *

UNITED STATES PATENT AND TRADEMARK OFFICE

CERTIFICATE OF CORRECTION

PATENT NO. : 4,449,475

DATED : May 22, 1984

INVENTOR(S) : FRANZ SCHINKE

It is certified that error appears in the above-identified patent and that said Letters Patent is hereby corrected as shown below:

In the claims:

Column 4, line 47, "8" should be --1--.

Signed and Sealed this

*Eighteenth* Day of *September 1984*

[SEAL]

*Attest:*

GERALD J. MOSSINGHOFF

*Attesting Officer*

*Commissioner of Patents and Trademarks*